US005396856A

United States Patent [19]

Bourrieres

[11] Patent Number: 5,396,856

[45] Date of Patent: Mar. 14, 1995

[54] SAILBOARD

[76] Inventor: Philippe Bourrieres, Villa Les Hérissons 20, Chemin des Clos Grands, Laberaudie Pradines, France, 46090

[21] Appl. No.: 122,587

[22] PCT Filed: Apr. 2, 1991

[86] PCT No.: PCT/FR91/00258

§ 371 Date: Oct. 4, 1993

§ 102(e) Date: Oct. 4, 1993

[87] PCT Pub. No.: WO92/17368

PCT Pub. Date: Oct. 15, 1992

[30] Foreign Application Priority Data

Mar. 2, 1990 [FR] France ..... 90 02643

[51] Int. Cl.[6] ..... B63B 35/00

[52] U.S. Cl. ..... 114/39.2; 114/93

[58] Field of Search ..... 114/39.1, 39.2, 89, 114/90, 91, 92, 93, 102, 103

[56] References Cited

U.S. PATENT DOCUMENTS 4,635,578 1/1987 Calcabrini et al. ..... 114/93
4,649,847 3/1987 Tinkler et al. ..... 114/39.2
4,730,568 3/1988 Campbell ..... 114/91
4,963,111 10/1990 Moulin ..... 114/39.2
5,018,468 5/1991 Peterson ..... 114/39.2

FOREIGN PATENT DOCUMENTS 2633242 12/1989 France .
3008427 9/1980 Germany .
2938877 4/1981 Germany .
3614350 10/1987 Germany .

*Primary Examiner*—Stephen P. Avila
*Attorney, Agent, or Firm*—Young & Thompson

[57] ABSTRACT

The sailboard (1) adapted to receive on its upper surface a mast (2) adapted to support a sail and fixed by a mast foot (3) on the board (1), and foot supports (4) adapted to retain the feet of a user of the board (1) and located rearwardly of the board (1) relative to the mast foot (3). It also comprises flexible elements (6) to support the mast foot (3) cantilevered above the board (1) and to transmit to the board (1) in a region situated rearwardly of the mast foot (3) the forces transmitted by this latter. Used particularly to control the vibrations of the board during its movement on water.

10 Claims, 4 Drawing Sheets

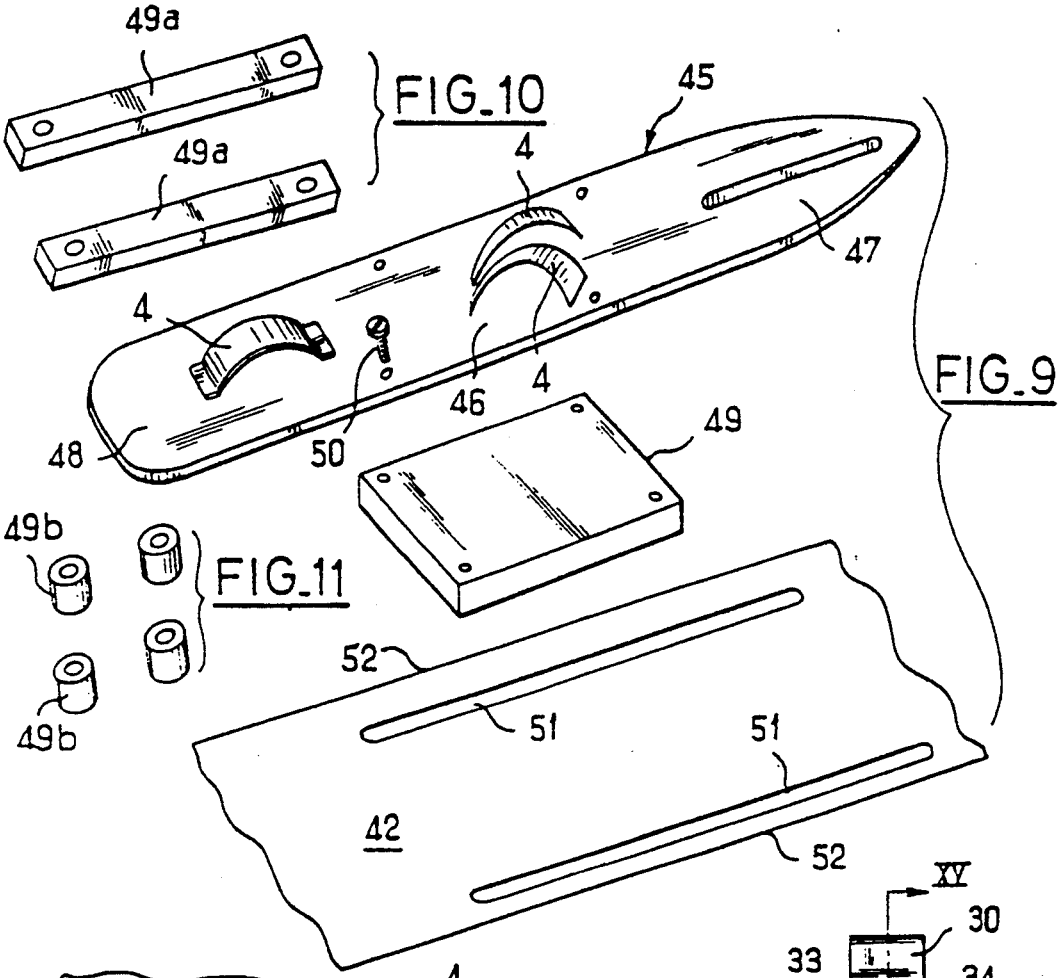
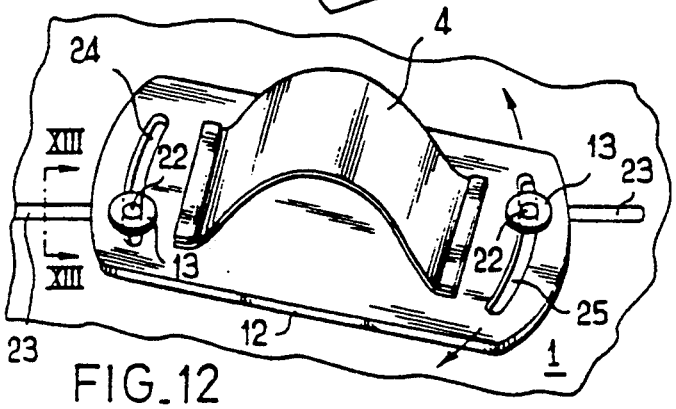
FIG_12
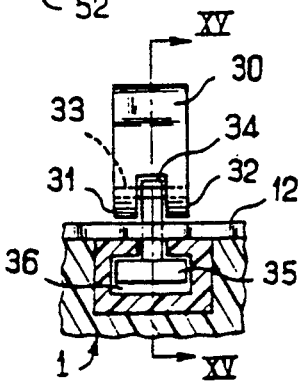
FIG_14
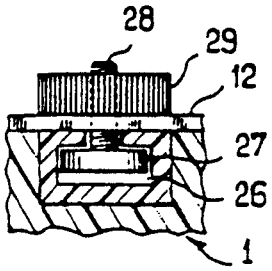
FIG_13
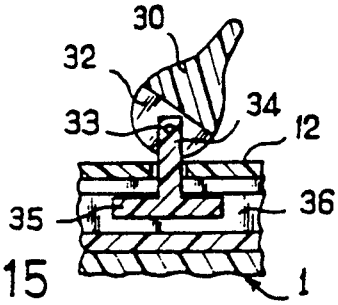
FIG_15

SAILBOARD

FIELD OF THE INVENTION

The present invention relates to a sailboard.

BACKGROUND OF THE INVENTION

Numerous types of sailboards are known which are generally adapted to receive on their upper surface a mast adapted to carry a sail and fixed by a mast foot on the board, and foot straps adapted to retain the feet of a user of the board and located rearwardly of the board relative to the mast foot.

It is known that a sailboard receives during its movements on the water dynamic forces of various natures: it receives on its lower surface in contact with the water forces due to the waves, to slapping, to landing after a jump; it also receives on its upper surfaces forces transmitted by the mast foot on the one hand, by the feet of the user retained by the footstrap on the other hand.

These various forces give rise to vibrations of the board. Generally speaking, these vibrations consume energy, requiring a supplemental physical effort on the part of the user of the board, and braking this latter. Moreover, certain of these vibrations, whose frequency corresponds to the frequency of the board itself, give rise to resonance phenomena which aggravate the recited drawbacks.

It is known that the frequency of the sailboard itself depends in particular on the distance separating the mast foot from the footstraps.

It is also known that for a given board, the emplacement of the mast foot is determined, for a given sail, by the position of the center of pressure of the sail, the conditions of navigation, the type and structure of the board. It is not therefore possible to modify this emplacement without risking loss of equilibrium and performance of the board.

Various internal structures of the board have been proposed: they have been able to improve the dynamic behavior of the board only in the case of low frequency vibrations, which are those that the user of the board can overcome at least partially by the action of his leg muscles.

It has also been proposed to mount the foot of the mast in a shock absorber adapted to absorb a portion of the forces transmitted by the latter: such a shock absorber can only function at the level of the amplitude of the vibrations, and not that of the creation of these latter.

SUMMARY OF THE INVENTION

The object of the present invention is to overcome the drawbacks of known sailboards, and to provide a sailboard in which the phenomena of resonance to low and medium frequency vibrations, which are the most troublesome, are at least to a great extent eliminated.

According to the present invention, the sailboard of the described type is characterized in that it comprises flexible means to support the mast foot in cantilever fashion above the board, and to transmit to the board in a region situated rearwardly of the mast head the forces transmitted by this latter.

The forces transmitted by the mast foot are thus transmitted to the board in a region situated rearwardly of the mast foot, therefore at a distance from the footstrap substantially less than on an ordinary board: the frequency of the board itself will thus be substantially offset toward the high frequency range, in which it is known that the corresponding vibrations have only a negligible effect on the performances of the board.

Moreover, because the mast foot is supported in cantilever fashion by flexible means, the forces and vibrations that it transmits will be at least in part absorbed before being transmitted to the board.

On the other hand, the emplacement of the mast foot remains unchanged on the board, such that the performances and equilibrium of this latter are in no way modified.

According to an interesting embodiment of the invention, the board also comprises flexible means to support the footstrap and the weight of the user of the board in cantilever above the latter and to transmit to the board in a region situated rearwardly of the mast head and in advance of the footstrap the forces transmitted by the feet of the user of the board.

This arrangement permits bringing toward each other a further substantial distance the respective points of application to the board of the forces transmitted to this latter by the mast foot and those transmitted by the footstraps. Such a bringing together permits offsetting again substantially the frequency of vibration of the board itself toward the high frequency range. The forces transmitted by the footstrap will also be at least in part absorbed by these flexible means before being transmitted to the board.

According to another interesting embodiment of the invention, the means to support the mast foot and, as the case may be, the means to support the footstraps and the weight of the user of the board are displaceable along this latter, and the mast foot and the footstraps are displaceable on their respective supports.

It is thus possible to adjust to the optimum the points of application of the mentioned forces as a function of the conditions of movement of the board, so that they will be appropriate for the board and the user of this latter, for example according to the type and structure of the board, the weight and shape and strength of the user, or independent of these latter, for example force and wind direction, frequency and amplitude of the surge or waves, type of movements provided to the board, jumps, speed runs, etc.

The user can thus better control the emplacement of the vibration nodes and the values of the frequencies of the board itself.

According to a preferred embodiment of the invention, the means to support the mast foot and the means to support the foot straps constitute a single element, which is an element elongated in the longitudinal direction of the board, this elongated element comprising a central section by which it is secured to the board, a forward section in cantilever relation above the board, which supports the mast foot, and a rear section, cantilevered above the board, which supports the footstraps and the weight of the user of the board.

The use of the invention is thus simple and easy, and hence less burdensome.

According to a preferred embodiment of the invention, the board comprises a lower rigid portion adapted to come into contact with the water and to give to the board substantially all its mechanical characteristics, and an upper light and flexible portion adapted to ensure the flotation of the board, and the elongated element is fixed to the lower rigid part of the board by its central portion.

Such an arrangement simplifies the force diagram which applies to the board during its movements, and which now sums up the essential vertical and downwardly directed forces transmitted by the central portion of the elongated element, on the one hand, and the pressure exerted by the water on the under surface of the board, pressure which is essentially vertical and directed upwardly, on the other hand.

These forces are applied moreover to a single lower rigid portion of the board whose mechanical characteristics can accordingly be optimized.

Other characteristics and advantages of the invention will become apparent from the following description:

BRIEF DESCRIPTION OF THE DRAWINGS

In the accompanying drawings, given by way of non-limiting examples:

FIG. 9 is an exploded fragmentary perspective view of the board shown in FIGS. 7 and 8;

FIGS. 10 and 11 are modifications of the crosspiece shown in FIG. 9;

FIG. 12 is a fragmentary perspective view of the sailboard according to the invention showing an adjustable footstrap according to the invention;

FIG. 13 is a fragmentary cross sectional view on XIII—XIII in FIG. 12;

FIG. 14 is a view similar to FIG. 13 of another embodiment of securement of the footstrap with eccentric support;

FIG. 15 is a fragmentary cross sectional view on XV—XV in FIG. 14.

DETAILED DESCRIPTION OF THE INVENTION

Figure 1:
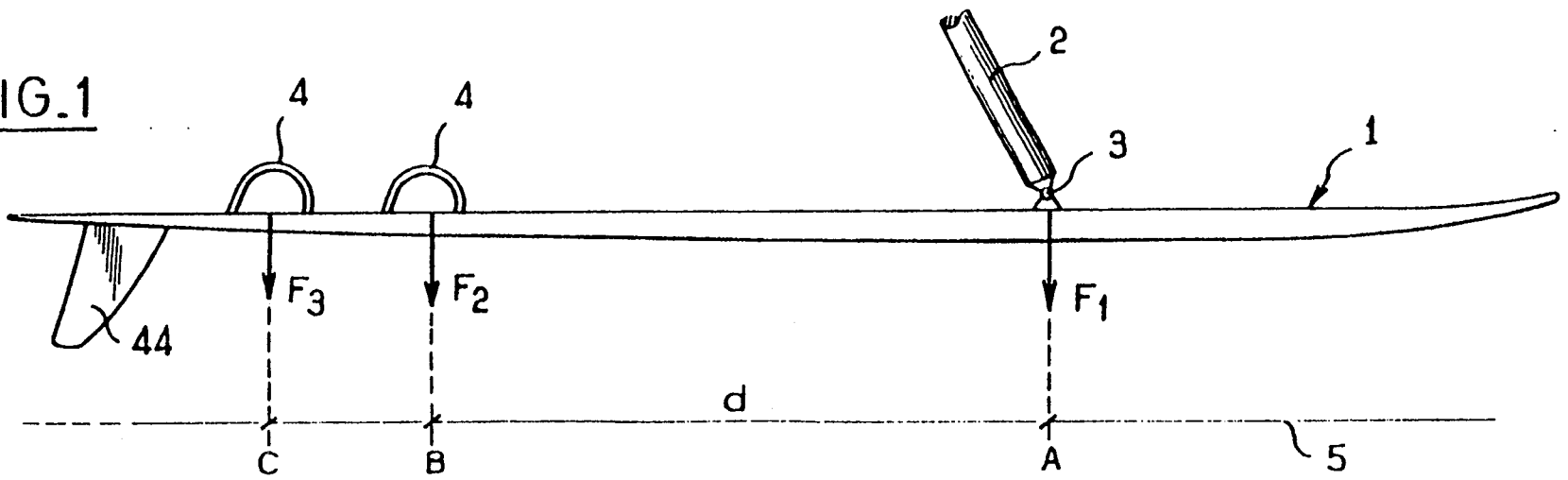
FIG. 1 is a schematic view partially in elevation of a sailboard according to the prior art.

In the embodiment shown in FIG. 1, the sailboard 1 comprises on its upper surface, in known manner, a mast 2 adapted to carry a sail (not shown) and fixed by a mast foot 3 on the board 1, and footstraps 4 adapted to retain the feet of a user of the board and situated rearwardly of the board relative to the mast foot 3.

It is known that the forces which board 1 receives on its upper surface are those transmitted respectively by the mast foot 3 and by the feet of a user retained by the footstraps 4: the vertical components of these forces are schematically shown respectively in the figure by the arrows $F_1$, $F_2$, $F_3$ of which the points of application projected on an axis 5 parallel to the longitudinal axis of the board are respectively A, B and C.

The emplacement of the mast foot 3, and that of the point A on axis 5, are determined for a given board and for a desired sail, by the position of the center of pressure of the sail, the conditions of navigation and the type of the board. The longitudinal distance separating the mast foot 3 and the nearest footstrap 4, which is to say the distance AB or d, is relatively great, for example of the order of 80 cm.

Figure 2:
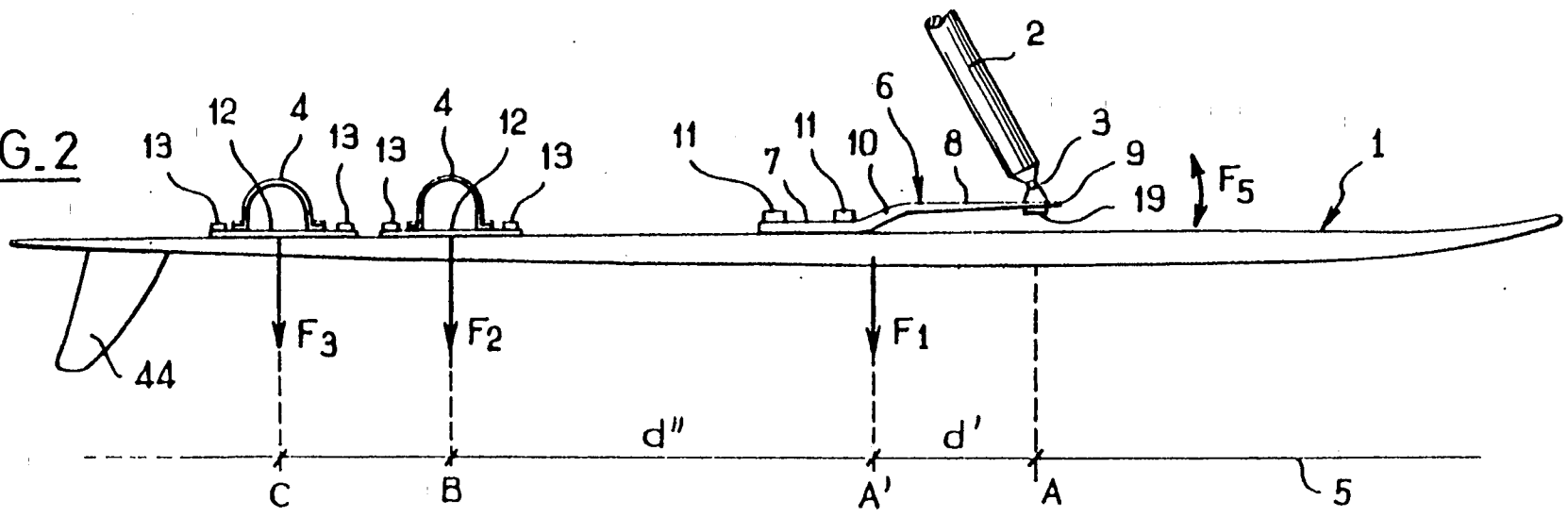
FIG. 2 is a view similar to FIG. 1 of a sailboard according to a first embodiment of the invention.

According to the invention, and as shown in FIG. 2, the board 1 comprises a flexible element 6 elongated substantially in the longitudinal direction of the board, this element comprising a rear section 7 by which it is secured to the board 1, and a forward flexible section 8 cantilevered over the upper surface of the board, the mast foot 3 being secured to the element 6 substantially at the forward end 9 of the forward section 8.

Thus, the vertical component $F_1$ of the forces transmitted by the mast foot 3 to the board 1 will be applied at a projected point A′ on the axis 5. The point A is located on the axis 5 forwardly of the point A′, by a distance $AA'=d'$. The distance A′B equal to d″ is thus equal to d-d′ and is substantially less than d.

It will thus be understood that the frequencies of vibration of the board itself under the action of the forces which are transmitted to it by the mast foot 3 and by the footstraps 4 are substantially offset toward the upper less troublesome frequencies.

There is thus obtained a substantial improvement of the vibrations for an overhang d′ of the order of 15 cm or more.

Moreover, the flexible nature of the element 6 ensures that the forces and vibrations transmitted by the mast foot 3 will be at least partially absorbed before being transmitted to the board.

In the illustrated example, the front and rear sections 7 and 8 of the element 6 are connected to each other by a medial section 10 of stepped shape which spaces the forward section 8 from the plane of section 7.

The element 6 is fixed to the board 1 by its rear section 7 by for example by two milled nuts 11.

The footstraps 4 are each fixed on a base 12 itself secured to the board by means for example of two milled nuts 13.

Figure 3:
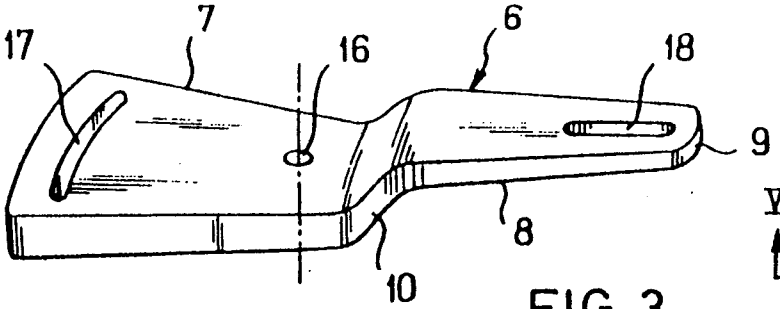
FIG. 3 is an enlarged perspective view of the device which supports the mast foot shown in FIG. 2.
Figure 4:
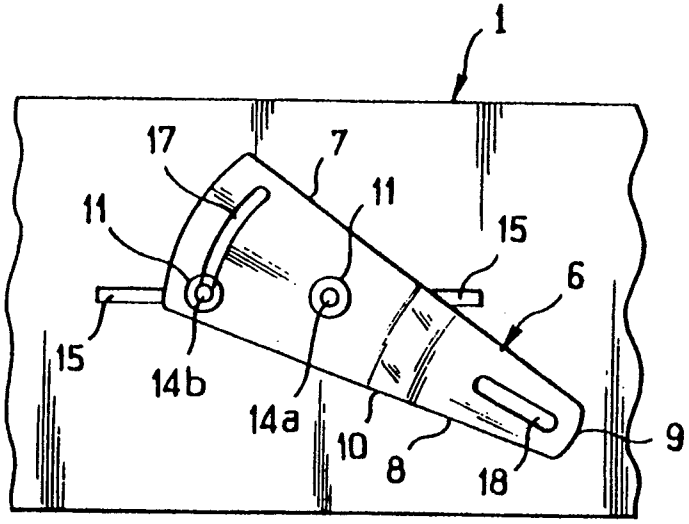
FIG. 4 is a fragmentary top plan view of a sailboard provided with the device of FIG. 3.

In the embodiment of FIGS. 3 and 4, the support 6 of the mast foot 3 is movable longitudinally along the board 1, and is adapted to pivot relative to the board about an axis substantially perpendicular to the upper surface of the latter.

To this end, the two milled nuts 11 are screwed on screws 14 whose heads are for example movable in a longitudinal slideway 15 provided in the upper surface of the board 1. The forwardmost screw **14*a* serves as the axis of rotation: it passes through a hole 16 provided in the support 6 near the medial portion 10 of the latter. The screw 14*b* located rearwardly of the screw 14*a*, passes through a circular slot 17 provided very near the rear end of the rear portion 7 of the support 6: the center of the slot 17 is on the axis of hole 16. The rear end of the support 6 is for this purpose enlarged to give a certain length to the slot 17 and to give also to the support 6** a certain angular swinging.

There will be seen later an example of securement of the screw heads 14 in the slideway 15.

The support 6 has near its forward end 9 a longitudinal slot 18 which permits varying the position of the mast foot 3. The mast foot 3 is fixed in the slot 18 in any known manner, for example by means of a milled nut 19 screwed on a screw secured to the mast foot 3 and which passes through the slot 18.

Figure 5:
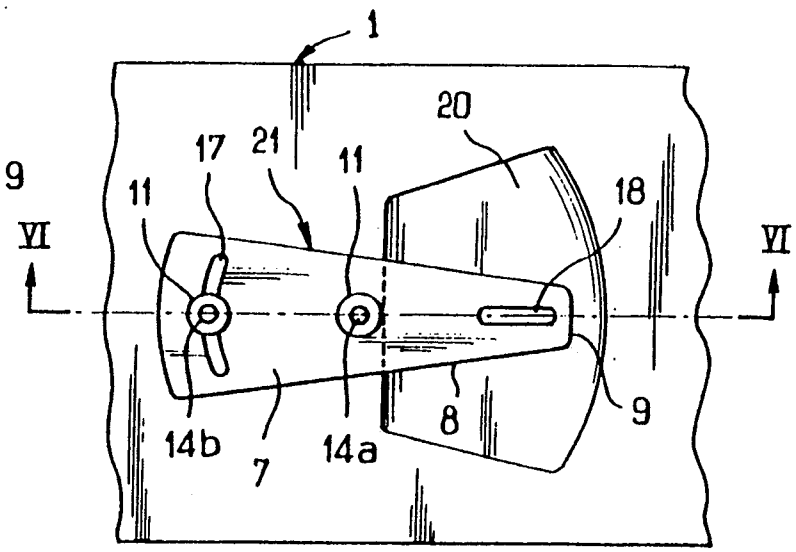
FIG. 5 is a view similar to FIG. 4 of another embodiment of sailboard according to the invention.
Figure 6:
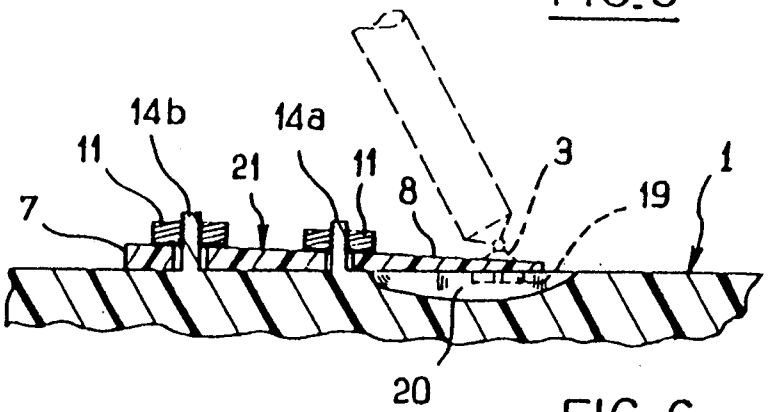
FIG. 6 is a cross-sectional view on VI—VI of FIG. 5.

In the embodiment of FIGS. 5 and 6, the upper surface of the board 1 comprises a hollowed portion 20 directly in line with the mast foot 3.

Because of this, the support can be a rectilinear element 21 whose forward portion 8 is cantilevered above the hollowed portion 20. The support 21 shown has at its rear portion a circular slot 17 permitting its pivoting about the screw 14*a*. It also has at its forward end a longitudinal slot 18 permitting the longitudinal adjustment of a mast foot 3. The screws 14*a* and 14*b* are shown fixed to the board 1. It will be understood that the screws 14*a* and 14*b* could also be movable in a slideway such as 15.

The embodiment of FIGS. 5 and 6 has the advantage of not raising the mast foot 3 as much as the embodiment of FIGS. 1,3 and 4. Only the central portion of the board is hollowed so as not to disturb the flow of water along the edges of this latter.

In these two embodiments, the flexible support 6, 21 can be of composite material reinforced by long fibers, for example. The support 6, 21 can have a sandwich structure comprising for example at least one layer of viscoelastic material to absorb vibrations.

Figure 7:
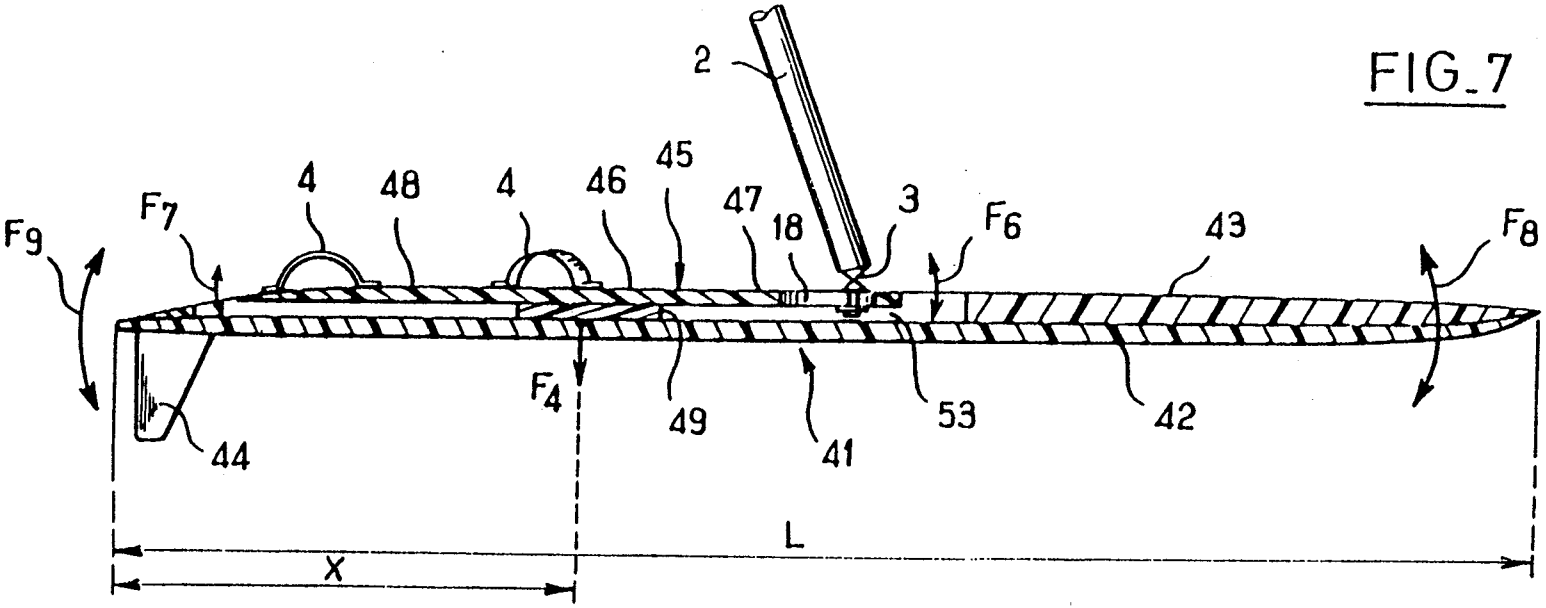
FIG. 7 is a longitudinal cross sectional view on VII—VII in FIG. 8 of a sailboard according to a second embodiment of the invention.
Figure 8:
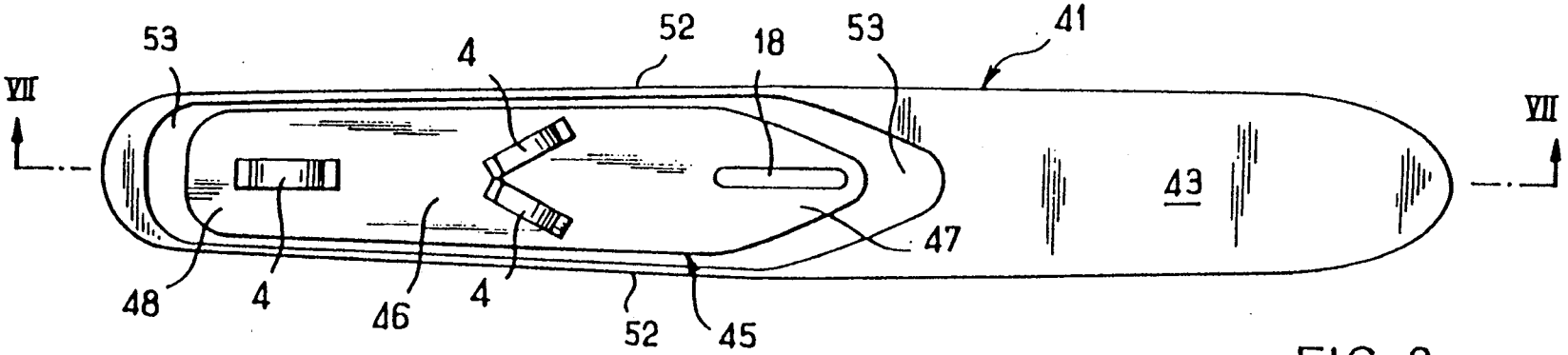
FIG. 8 is a top plan view of the board shown in FIG. 7, the mast being removed.

In the embodiment of FIGS. 7, 8 and 9, the board 41 comprises a lower rigid portion 42 adapted to come into contact with the water and to give to the board 41 substantially all its mechanical characteristics, and an upper portion 43 which is light and flexible adapted to ensure the flotation of the board 1.

The lower rigid portion 42 is for example of a synthetic material reinforced by longitudinal fibers, and may be constituted of several layers and have a stratified or composite structure. It supports the fin 44, as the case may be a drop keel (not shown) in its well.

The lower rigid portion 42 can thus have for example a sandwich structure comprising a core, made for example of expanded foam or a honeycombed or profiled structure, and, on opposite sides of this core, a resistant layer or skin constituted of fibers, for example of glass, carbon or aramide, encased in a thermosetting resin. The resistant skin can also be of a thermoplastic material, which can include or not fibers of the above type.

As a modification, the first portion 42 could have a known stratified structure constituted of several superposed layers:

- certain of these layers containing longitudinally arranged fibers, others containing fibers disposed for example transversely or in two mutually perpendicular directions and each forming an angle of 45° with the longitudinal direction; these layers are encased in thermosetting or thermoplastic resins;
- certain of these layers are constituted of the core materials recited above;
- certain of these layers can be layers of interleaved viscoelastic material to impart greater shock absorbing properties to the structure. The viscoelastic material, being subjected to shearing constraints, will dissipate the energy transmitted to the structure in the form of heat.

Such layers are known in themselves and do not need to be described and shown in detail.

The structure of the first portion 42 is thus so conceived as to optimize the performances of the board 41 by taking account solely of the physical and mechanical parameters such as the load on the board, the distribution and rigidity in flexure and in torsion, dynamic characteristics of the board, water flow along the latter, resistance to rupture.

The upper portion 43 is of a light and flexible material, for example an expanded foam, or has an inflatable structure. This upper portion is not adapted to support the forces transmitted to the board 41 by the mast foot 3 and by the feet of the user of the board locked in the footstraps 4.

The board 41 comprises to this end a single flexible member 45 to support both the mast foot 3 and the footstraps 4 as well as the weight of the user of the board, cantilevered above the board 41.

In the illustrated example, this single element is a support 5 elongated in the longitudinal direction of the board 41; the support 45 comprises a central section 47 by which it is secured to the board 41, a forward flexible section 47 cantilevered above the board 41, which supports the mast foot 3 and a rear flexible section 48 cantilevered above the board, which supports the footstraps 4 and the weight of the user of the board 41.

The forward section 47 has, similarly to the support 6 in FIGS. 2 to 6, a longitudinal slot 18 which permits varying the position of the mast foot 3 by unscrewing the nut 19.

The elongated support 45 is secured to the lower part 42 of the board 41 by its central portion 46. As shown in FIG. 9, this section 46 is secured to a solid crosspiece 49 itself secured to the lower portion 42 of the board 41.

The crosspiece 49 could obviously be integral with the support 45, or be replaced by equivalent elements, for example two longitudinal rods 49*a* (see FIG. 10) or rigid or flexible lugs, for example elastic supports 49*b* (see FIG. 11).

The position of the support 45 is adjustable on the lower portion 42 of the board 41.

In the example shown in FIG. 9, the crosspiece 49 is secured to this portion 42 by securement elements 50, for example bolts, adapted to slide in slideways 51 disposed longitudinally lengthwise of the lateral sides 52 of the lower portion 42 of the board 41. The slideways 51 could be replaced by inserts (not shown) sunk into different portions of the lower portion 42 and tapped so as to receive securement screws of the central section 46.

It is also seen in FIG. 7 that the vertical forces transmitted to the board 41 by the mast foot 3 and the feet of the user of the board 41 retained in footstraps 4 can be considered as a force $F_4$ applied to point P adjacent the center of the crosspiece 49. The point P is a distance X from the rear end of the board 41. The ratio between the distance X and the total length L of the board should be comprised between 2 and 5 and is preferably about 3.

The crosspiece 49 preferably has a length of about 20 cm and a thickness of about 3 cm, for example. It is made of a suitable rigid material.

The upper portion 43 of the board 41 is secured to the lower portion 42 of the latter, but is independent of the elongated support 45. It has for this purpose a recessed portion 53 so as to permit the sliding or the displacement of the latter, as well as the vibrations of the forward cantilevered front and rear portions 47 and 48 of the latter.

There will now be described in detail with reference to a footstrap 4 fixed to the board 1, examples of known manners of longitudinally and/or transversely adjustable securement: these modes of securement are usable to secure the mast foot 3 and the footstraps 4 on the board 1 according to the embodiment of FIGS. 2 to 6, or on the support 46 of the board 41 according to the embodiment of FIGS. 7 to 9. The are also usable for the securement of the crosspieces 49, 49*a*, 49*b* on the lower portion 42 of the board 41.

In the embodiment of FIG. 12, the base 12 of the footstrap 4 is movable in the longitudinal direction of the board 1 and is adapted to pivot relative to the board 1 about an axis substantially perpendicular to the upper surface of the latter.

To this end, the support 12 is fixed on the board, substantially as the support 6, for example by milled nuts screwed on screws 22 of which the head is movable in a slideway 23 extending substantially in the longitudinal direction of the board.

The base 12 has at its two longitudinal ends respectively two circular slots 24, 25 diametrically opposed on a same circle. The screws 22 pass through respectively one or the other of the slots 24, 25. Upon unscrewing the milled nuts 13, the base 12 can thus be caused to pivot relative to the board 1.

It will be understood that it is also possible to replace one of the slots 24, 25 by a simple hole receiving a screw 22 which then serves as an axle of rotation, the single slot being obviously centered on said hole.

In the embodiment of FIG. 13, the slideway 26 shown can serve as well as the slideway 15 for securement of the support 6 as for the slideway 13 for securement of the base 12 of the footstrap 4.

The slideway 26 is for example constituted by an extruded profile of U-shaped cross section the ends of whose legs are inwardly directed. The head 27 of the screw 28 is thus retained by said inwardly directed ends, and only the body of the screw 28 emerges from the slideway. A milled nut 29 is screwed on the screw 28. The nut 29 and the screw 28 can thus be used as well in place of the nuts 11 and screws 14 for securement of support 6, 21 as in place of the nuts 13 and screws 22 for securement of the base 12 of the footstrap 4.

In the embodiment of FIGS. 13 and 14, this securement by screw 28 and nut 29 is replaced by an eccentric pivoting element 30, which is known per se and which will be only briefly described.

The eccentric element 30 comprises two parallel flanges 31 and 32 which carry the pivotal axle 33 and which surround the support rod 34 fixed to the head 35 retained in the slideway 36.

When the element 30 is pivoted from one side to the other, the flanges 31 and 32 bear on the edges of the slideway and block the said assembly.

All the elements described above are preferably of plastic material, but certain of them can also be of light metal, particularly the slideways, the screws and the nuts.

It will thus be seen that the two embodiments described above of the sailboard of the invention permit displacing toward the high frequency range the vibrational frequencies of said board by bringing toward each other the points of application on the board of the forces transmitted to the latter by the mast foot 3, on the one hand, by the feet of the user of the board locked in the footstraps 4, on the other hand. These forces are moreover at least in part absorbed before being transmitted to the board. In the two embodiments described, the flexible cantilevered support of the mast foot 3 serves also to absorb vibrations of the board and shocks of the latter against the water and the waves, before transmitting them to the mast and to the sail, which has a favorable effect on the stability of the sail.

In the embodiment of FIGS. 2 to 6, the support 6, 21 vibrates as indicated by the arrow 5 in FIG. 2.

In the embodiment of FIGS. 7 to 9, the forward and rear sections 47 and 48 of support 45 vibrate as indicated respectively by the arrows $F_6$ and $F_7$ in FIG. 7. Moreover, because of the particular structure of the board 41, the forward and rear portions of this latter flex and/or vibrate respectively as indicated by arrows $F_8$ and $F_9$.

By way of example, there can be cited for the mast foot an adjustable cantilevered length between about 15 and 30 cm, and a half wave amplitude of oscillation of ±20 mm relative to the rest position for an overhanging length of about 20 cm.

Of course, the invention is not limited to the embodiments which have been described, and there can be brought to these latter numerous changes and modifications without departing from the scope of the invention.

Thus, for example, the support 6 could be comprised of two parts, a base fixed on the board and adjustable relative to the latter, and a flat element fixed to the base and bearing the mast foot 3 in cantilevered relation, this flat element being itself adjustable relative to the base, to permit modifying for example the length of the cantilever and therefore the rigidity of the cantilevered part.

The mast foot could be adjustable transversely on the forward section 47 of the support 45.

Similarly, there were described above adjustments according to the invention to be performed solely when the board is stationary, on land or on water.

It is obviously possible, particularly for example with the eccentric element 30, to provide that the user can modify himself the adjustments during movement of the board, by unlocking and relocking the eccentrics.

It is also possible not to block either the support of the mast foot nor the bases of the footstraps, and to leave these elements to take an optimum position either naturally or under impulse from the user of the board.

The invention is also applicable no matter what the number or type of the footstraps, this number and this type being possibly different from those described.

Finally, the support 45 could be adapted to an ordinary board such as the board 1, the cross member 49 being fixed on the upper portion of the board. The support 45 could also be fixed on the board in the manner described for the support 21 in FIGS. 5 and 6, the board comprising in its upper portion a recessed portion such as 20 below the forward section 41 and another below the rear section 48.

Moreover, it is possible to give to the upper portion 43 which is light and flexible in the embodiment of FIGS. 7 to 9, a discontinuous structure, for example in the form of plates disposed substantially transversely relative to the board 41, independent from each other and individually connected to the first portion 42. These plates, which are for example cemented to the first portion 42, comprise a principal core substantially perpendicular to the portion 42 and directed transversely relative to the latter. This core is rearwardly prolonged relative to the board substantially in the longitudinal direction of the latter, by lateral edges nearer the lateral edges of the board than the ends of the core and which enclose the core of the plate situated immediately behind the first, so as to channel the water and avoid braking the streams of water, which would have the effect of braking the board. For the same reason, the core is prolonged, at its upper end, by an upper flange directed substantially rearwardly of the board and which covers the core of the following plate. As a modification, the cores of these plates incline rearwardly of the board 41 to facilitate the flow of water. The lateral edges are detached from the upper surface of the first portion 42 so as to have no effect of stiffening this latter.

To avoid braking the water streams between the portion 42 and the edges of the plates, leaves are preferably secured on the section of the board 41 along the side longitudinal edges of this latter, so as to guide the water and to avoid contact of the latter with the lateral edges of the plates: the water passing above these leaves can always flow rearwardly of the board 41 because of the rising up out of the water of this latter. It will be understood that the plates permit providing a second portion 43 of the board 41 having the necessary volume to ensure the flotation of the latter without affecting the mechanical characteristics of the first portion 42, in particular its longitudinal flexibility: thus, these plates have no or practically no longitudinal portion susceptible of serving as stiffening ribs.

Moreover, in the embodiment of FIGS. 7 and 8, the hollowed portion 53 of the upper portion 43 of the board 41 can be covered with an elastic skin (not shown) which is sealed and also covers the flexible support 45 without preventing the swinging of the cantilevered sections 47 and 48; one can thus avoid all entry of water into this hollowed portion 53 so as not to increase the weight of the board 41. Such a skin, known per se, could if desired be removable.

Given the securement means and adjustment means described above for the support 45, there could also be provided such a removable support 45 fixed as desired on one or the other of several boards 41 having different mechanical characteristics selected by the user as a function of the local conditions of sailing.

I claim:

1. Sailboard adapted to receive on its upper surface a mast adapted to carry a sail and fixed by a mast foot on the board, and footstraps adapted to retain the feet of a user of the board and located rearwardly of the board relative to the foot of the mast, said board comprising flexible means extending substantially in a longitudinal direction and cantilevered above the board for supporting the mast foot and for transmitting to the board in a region located rearwardly of the mast foot forces transmitted by said mast foot, and wherein said flexible means are situated entirely forwardly of the board relative to the footstraps.

2. Sailboard according to claim 1, further including additional flexible means for supporting the footstraps and the weight of the user of the board, said additional flexible means being cantilevered above the board for transmitting to the board in a region situated rearwardly of the mast foot and forwardly of the footstraps forces transmitted by the feet of the user to the board.

3. Sailboard according to claim 2, wherein the flexible means for supporting the mast foot and the additional flexible means for supporting the foot straps are displaceable along said board.

4. Sailboard according to claim 2, wherein the mast foot and the footstraps are displaceable along their respective supports.

5. Sailboard according to claim 2, wherein the flexible means for supporting the mast foot and the additional flexible means for supporting the foot straps constitute a single element.

6. Sailboard according to claim 5, wherein said single element is elongated in the longitudinal direction of the board, said elongated element comprising a central section for securing said element to the board, a forward section cantilevered above the board for supporting the mast foot, and a rear section cantilevered above the board for supporting the footstraps and the weight of the user of the board.

7. Sailboard according to claim 6, wherein the board comprises a rigid lower portion adapted to come into contact with the water and to impart to the board substantially all its mechanical characteristics, and an upper portion which is light, flexible and adapted to ensure the flotation of the board, and wherein the elongated element is secured to the lower rigid portion of the board by its central section.

8. Sailboard according to claim 2, wherein the upper surface of the board comprises a hollowed portion below the flexible means for supporting the mast foot and below the additional flexible means for supporting the foot straps and the weight of the user of the board.

9. Sailboard according to claim 5, wherein the single element is removably fixed on the board.

10. Sailboard according to claim 1, wherein the flexible means for supporting the mast foot comprises a rear section secured to the board, and a forward cantilevered flexible portion spaced from and extending substantially parallel to the board.

* * * * *